US006109559A

United States Patent [19]

Dörfel et al.

[11] Patent Number: 6,109,559

[45] Date of Patent: Aug. 29, 2000

[54] RIDER ROLL UNIT FOR WINDING MACHINES

[76] Inventors: G. Walter Dörfel, Beethovenstrasse 21, Boll, Germany, 7325; Bernd Goerner, 7315 Weilheimm, Baden-Wurttemberg, Germany

[21] Appl. No.: 09/171,846

[22] PCT Filed: Jun. 13, 1997

[86] PCT No.: PCT/EP97/03094

§ 371 Date: Oct. 26, 1998

§ 102(e) Date: Oct. 26, 1998

[87] PCT Pub. No.: WO97/47543

PCT Pub. Date: Dec. 18, 1997

[30] Foreign Application Priority Data

Jun. 13, 1996 [DE] Germany ..... 296 10 197 U

[51] Int. Cl.[7] ..... B65H 18/20; B65H 18/26; B65H 19/30

[52] U.S. Cl. ..... 242/533.2; 242/541.5

[58] Field of Search ..... 242/533.2, 541.5, 242/541.6, 547

[56] References Cited

U.S. PATENT DOCUMENTS

| | | | |
|---|---|---|---|
| 4,180,216 | 12/1979 | Dahl et al. | 242/541.5 |
| 4,404,831 | 9/1983 | Hild et al. . | |
| 4,524,919 | 6/1985 | Wehrmann | 242/541.5 |
| 4,842,209 | 6/1989 | Saukkonen | 242/533.2 |
| 4,867,387 | 9/1989 | Schonmeier | 242/541.6 |
| 4,932,599 | 6/1990 | Doerfel | 242/533.2 |
| 5,275,345 | 1/1994 | Stahl et al. | 242/547 |
| 5,732,902 | 3/1998 | Tomma et al. | 242/541.5 |
| 5,806,783 | 9/1998 | Turunen | 242/541.5 |

FOREIGN PATENT DOCUMENTS

| | | |
|---|---|---|
| 0393519 | 10/1990 | European Pat. Off. . |
| 0640544 | 3/1995 | European Pat. Off. . |
| 3816774 | 12/1988 | Germany . |
| 60-112556 | 6/1985 | Japan . |
| 62-083963 | 4/1987 | Japan . |
| 2018728 | 10/1979 | United Kingdom . |

*Primary Examiner*—John M. Jillions

[57] ABSTRACT

The invention pertains to a rider roll unit for winding machines with at least one support or carrier drum for winding web-like material to be wound with at least one rider roll (1) rotatably mounted to a tie-bar (2) for placing the roll (12) to be wound under a load, as a function of its diameter with pivotably mounted arms (3) to support the tie-bar (2) and with a drive (9) for pivoting the support arms (3) as a function of the change in diameter of the roll (12) to be wound.

For optimizing the winding structure, the tie-bar (2) with the rider roll (1) can pivot at the support arms (3) around the first axle (10) parallel to the support roll, and a guide-bar (4) hinged at the tie-bar (2) around a second axle (11) parallel to the support roll causes a forced pivoting of the tie-bar (2) with the rider roll (1) about the first axle (10), when the tie-bar (2) with the rider roll (1) is lifted in accordance with the increasing diameter of the roll, so that the acting direction of the rider roll (1) changes on the roll (12).

Thus, the operating direction of the rider roll is always at a right angle with respect to the surface of the wound roll making it possible to use highly sensitive control means to control the contact pressure.

5 Claims, 3 Drawing Sheets

Figures 1, 2:
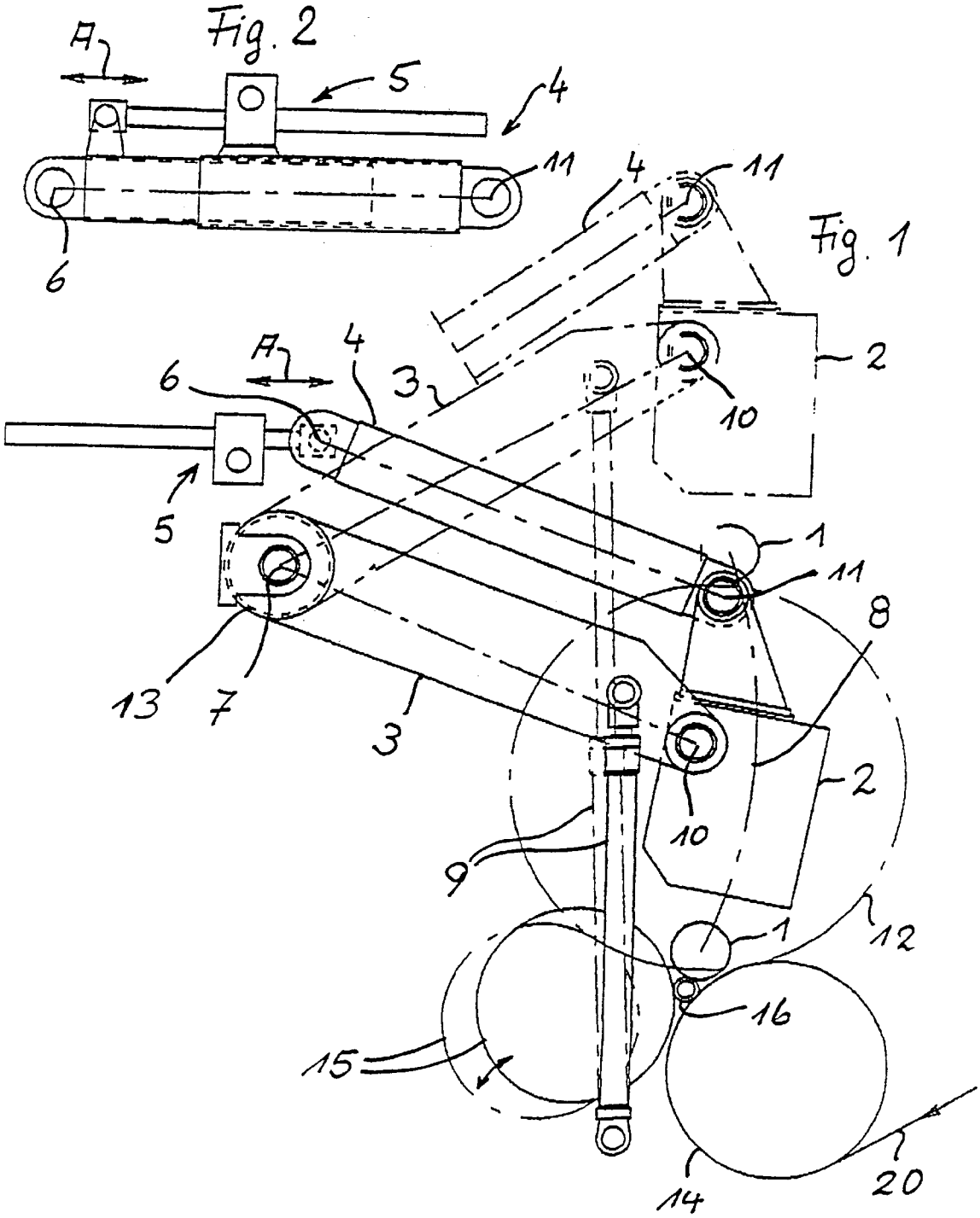

A
5
4
11
6

4
11
2
10
A
6
4
3
5
1
11
8
13
7
3
2
10
9
12
1
16
15
14
20

RIDER ROLL UNIT FOR WINDING MACHINES

The invention pertains to a rider roll unit for winding machines with at least one support or carrier drum for winding web-like material to be wound, in particular paper or the like with at least one rider roll rotatably mounted to a tie-bar for placing the roll to be wound under a load, as a function of its diameter with pivotably mounted arms to support the tie-bar and with drive means for pivoting the support arms as a function of the change in diameter of the roll to be wound.

A rider roll unit of this kind is known from EP-A1 0,640,544 in conjunction with a double support drum in which the second support drum in the web running direction can be lowered during the winding process.

For use in so called center drive winders, the DE 39 18 520 A1 and the WO 95/32908 disclose devices with load roll units comprising frames bearing two rolls around which an endless belt is fitted running. The load roll units as a whole may be tilted along a pass approximately parallel to the circumference of the roll to be wound by means of lever arms and a first group of piston/cylinder units. A second group of piston/cylinder units is used to tilt the frame in order to keep the nip load between the roll to be wound and the load roll unit uniform. The first and second group of piston/cylinder units are independly moved.

The DE 38 16 774 A1discloses a winder with a load roll and two support rollers, one of which is a belt roller arrangement. The load roll is borne at a support beam fixedly mounted to the end of a tilt arm that may be tilted around a stationary articulation point by means of a first cylinder/piston unit. A second piston/cylinder unit is arranged exactly parallel to the tilt arm in order to lift said load roll when the winding is finished.

SUMMARY OF THE INVENTION

To optimize the winding structure according to this invention, it is proposed that in a generic rider roll unit, the tie-bar with the rider roll can pivot at the support arms around the first axle parallel to the support drum, and a guide-bar articulated at the tie-bar pivotable around a second axle parallel to the support drum causes a forced pivoting of the tie-bar with the rider roll about the first axle, when the tie-bar with the rider roll is elevated in adapting to the increasing diameter of the roll, so that the acting direction of the rider roll changes on the roll.

Through suitable selection of the guide-bar geometry, due to the invention the result is, on the one hand, that the operating direction of the rider roll is always at a right angle with respect to the surface of the roll being wound. Thus, it is possible to use highly sensitive control means to control the contact pressure of the rider roll against the roll being wound. Control means of this kind are known from PCT/EP 96/01877. On the other hand, through suitable selection of the guide-bar geometry, a base motion line of the rider roll can be specified in accordance with the increasing diameter of the growing roll, such that the load distribution of the rider roll on the first and on the second support drum changes in accordance with the increasing roll diameter in order to achieve on optimal winding structure.

The winding structure can also be affected significantly by the fact that the geometry of the guide-bar is variable, and specifically either before beginning a new winding process and/or during each winding process. Particularly preferred is a guide-bar with variable active length or a guide-bar with a locally variable articulation point. Basically it is also possible, alternatively or cumulatively, to affect the guide-bar geometry by changes in the support arms, in particular, by realizing a variable length or by changing the location of the articulation point on the machine side.

Rider roll units with variable guide-bar geometry also make it possible to implement supplemental functions, for example, using the rider roll as a roll ejector.

The components or process steps stated above, and also those claimed or described in detail in the embodiment according to this invention, are not subject to any particular exemptions with respect to their size, structure, material selection and technical concept or process conditions, so that the selection criteria known in the particular field of application can be applied without limitations.

Figure 3:
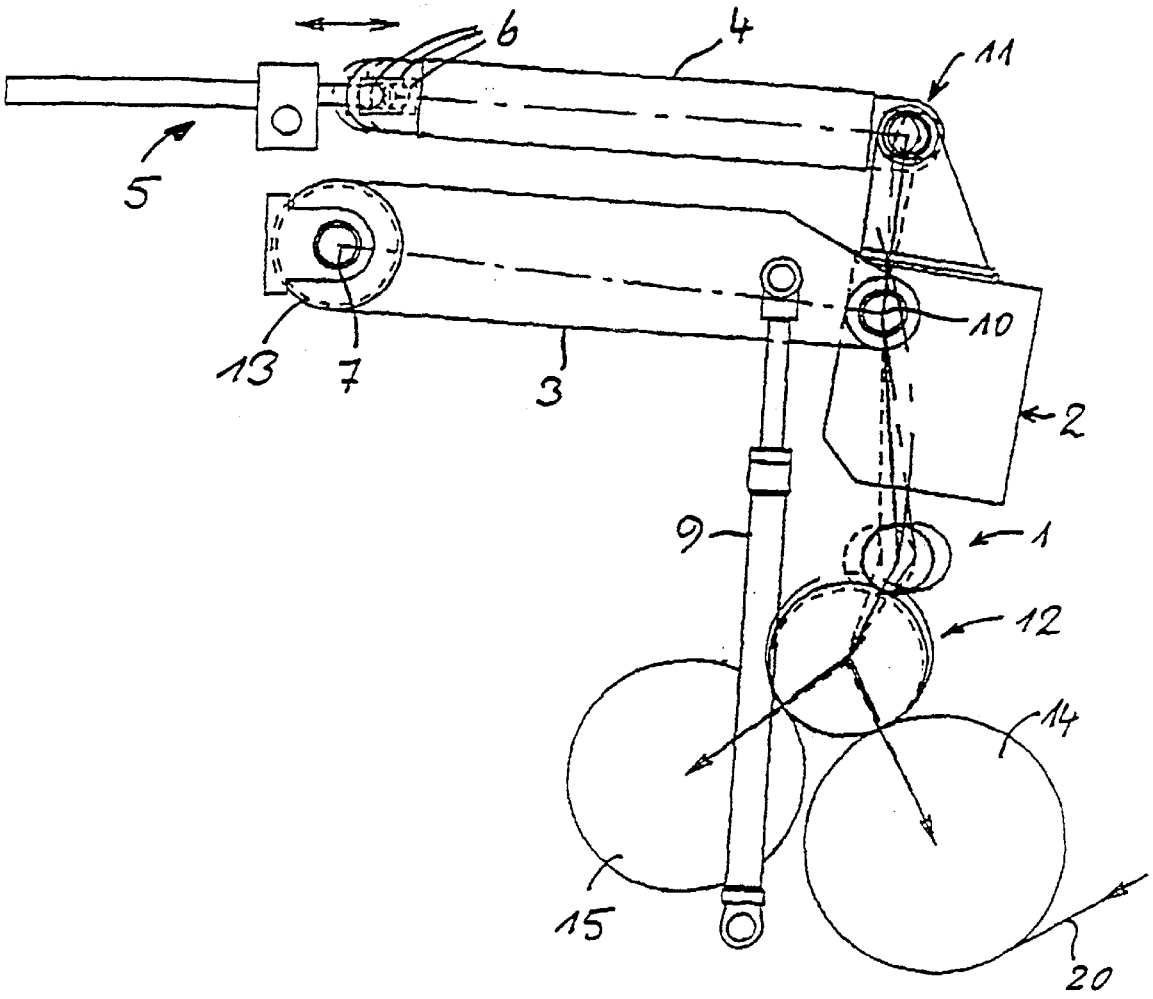
Figure 3:
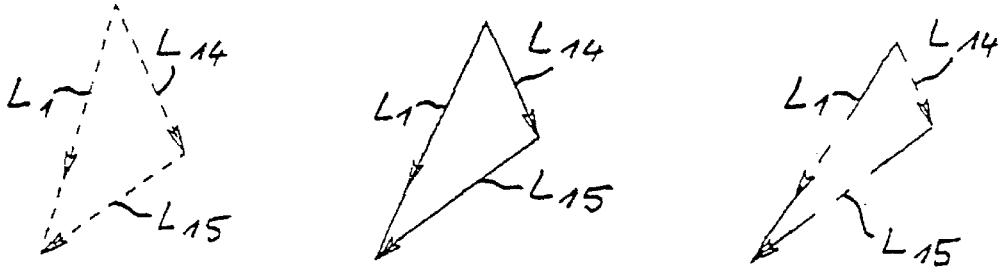
Figure 4:
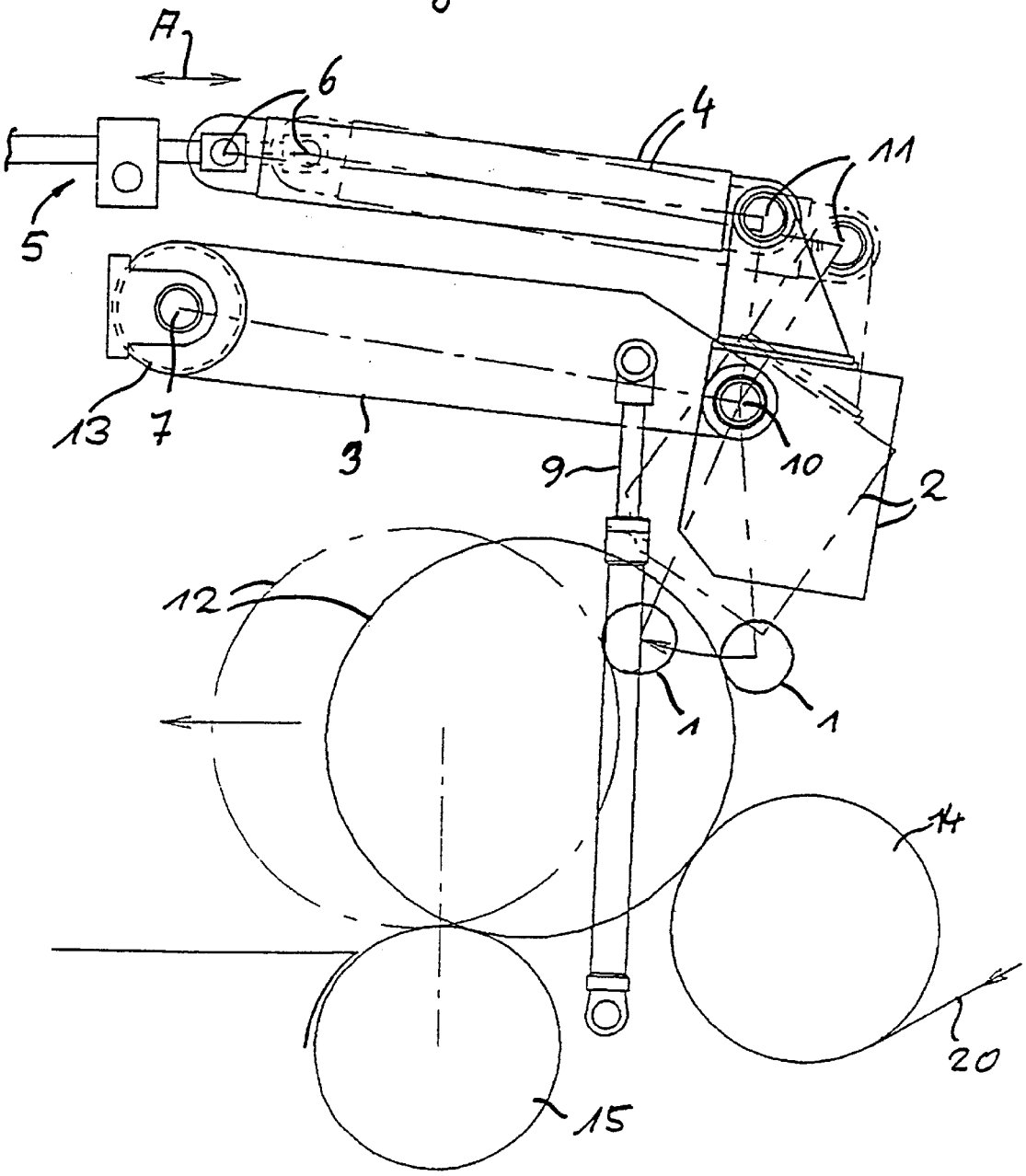

Additional details, properties and advantages of the subject matter of the invention are disclosed in the following description of the attached drawings, in which—exemplary—one preferred embodiment of a rider roll unit according to this invention is shown. The figures present:

FIG. 1 A rider roll unit for a winding machine with two support drums, one of which is position-variable, in a front side view in two working positions of the rider roll;

FIG. 2 An alternative design of the rider roll unit according to FIG. 1 in which the geometry of the guide-bar is different;

FIG. 3 An interim position of the rider roll of the rider roll unit according to FIG. 1, together with variants for different guide-bar geometries, including the associated force distribution triangle; and FIG. 4 An additional working position of the same rider roll unit as in FIGS. 1 and 3, in which the rider roll unit is used as a roll ejector.

As is evident in FIG. 1, the shown rider roll unit is used for a winding machine with two support drums 14 and 15; of them, the second support drum 15 viewed in the running direction of the webs 20 to be wound can be lowered as the diameter of the roll 12 being wound increases, causing an increase of the spacing between the second support drum and the first support drum, i.e., the support drum 14 around which the web wraps.

An inherently known rider roll 1, we are dealing preferably with a rider roll composed of a number of single rollers, as described in detail in PCT/EP 96/01877 is attached in a relatively moving manner, as known from PCT/EP 96/01877 and therefore not presented in detail in the figures, to a tie-bar 2 extending across the entire width of the machine and approximately parallel to the support drums 14 and 15. The tie-bar 2 plus the rider roll 1 can be lifted as a function of the change in diameter of the roll 12 being wound in a known manner, for example, as described in EP-A1 0,640,544, by means of support arms 3 borne at the machine frame pivotable about a pivot axle 7 and by means of drive means 9 engaging with said support arms 3; it can be lowered again for a new winding process. A torsion tube 13 can be used to connect the support arms 3 located essentially to the side of the front ends of the support drums 14 and 15.

In contrast to the rider roll unit known from EP-A1 0,640,544, the tie-bar 2 is mounted to the support arms 3 rotatably about the first axle 10. In addition, it comprises a second axle 11 located at a distance from the first axle 10, on which a guide-bar 4 is pivot mounted, and its second articulation point 6 is pivot mounted to the end of a displacement means 5, for example, a driven spindle.

In FIG. 1, the solid lines represent a first, extreme position of the rider roll unit, namely the winding position in which the one or several web(s) 20 begin to be wrapped around one or more winding core(s) 16. The spacing gap between the two support drums 14 and 15 forming a winding bed is minimal and the rider roll 1 rests against the winding core 16 such that the operating direction of the rider roll 1 on the winding cores 16 is approximately at a right angle, with respect to the underside of the tie-bar.

The dashed lines in FIG. 1 represent a second, extreme position of the rider roll unit, in which the roll 12 is located at the end of the winding process. With a rigid link between support arms 3 and tie-bar 2, in accordance with the state of the art, the pivot path through which the support arms 3 travel to the two extreme positions would result in that the underside of the tie-bar 2 would be in a significantly slanted position with respect to the horizontal. Whereas, the guide-bar device according to this invention results in that the midpoint curve of the rider roll 1 describes a comparatively flat base line of motion 8 and the underside of the tie-bar extends approximately at a right angle with respect to the connecting line between rider roll 1 and roll 12. Thus, it is possible that a highly sensitive means can be used to adjust the contact pressure of the rider roll 1, like that described in PCT/EP 96/01877.

In FIG. 1, the double arrow A indicates that the position of the articulation point 6 of the guide-bar 4 can be changed with respect to the machine frame. The representation according to FIG. 1, however, has been selected as if the articulation point 6 is position-invariant. Therefore, the midpoint curve of the rider roll 1 represented by the dashed lines, also relates to a so-called base line of motion of the rider roll unit.

Consequently, the midpoint curve of the rider roll 1 can be changed by changing the position of the articulation point 6 before or during a winding process, as compared to the base line of motion 8 shown in FIG. 1, with regard to its location and flexure.

Another possibility for changing the geometry of the guide-bar is indicated in FIG. 2. Accordingly, articulation point 6 of the guide-bar 4 is in a fixed position with respect to the machine, but its length is variable through displacement means 5, such as a spindle drive.

In FIG. 3 we see the support arms 3 for a specific pivot position, showing how the load distribution of the rider roll on the two support drums can be changed significantly by changing the geometry of the guide-bar. For reasons of conciseness, not all lines, but rather only the most important components, are illustrated in their various positions. This includes firstly, the articulation point 6, which takes on three different positions. And secondly, in this regard, the positions of the rider roll 1 belonging to the individual articulation point positions are a part of this. Slightly different roll diameters belong to the three geometries of the guide-bar. As the three force parallelograms belonging to the individual guide-bar geometries show, with the same contact load L1 of the rider roll 1, the load distribution L14 on the first support drum and L15 on the second support drum significantly differ.

Finally, FIG. 4 illustrates how a variable guide-bar geometry can also be used to eject a finished roll 12 from the winding bed at the end of the winding process by means of the load roll 1.

List of Reference Numerals

1 Rider roll
2 Tie-bar
3 Support arms
4 Guide-bar
5 Displacement feature
6 Articulation point
7 Pivot axle
8 Base line of motion
9 Drive unit
10 First axle
11 Second axle
12 Roll
13 Torsion tube
14 First support drum
15 Second support drum
16 Winding core
20 Webs

What is claimed is:

1. Rider roll unit for winding machines with at least one support or carrier drum for winding web-like material to be wound with at least one rider roll (1) rotatably mounted to a tie-bar (2) for placing the roll (12) to be wound under a load, as a function of its diameter with pivotably mounted arms (3) to support the tie-bar (2) and with drive means (9) for pivoting the support arms (3) as a function of the change in diameter of the roll (12) to be wound characterized in that the tie-bar (2) with the rider roll (1) can pivot at the support arms (3) around a first axle (10) parallel to the support roll, and a guide-bar (4) articulated at the tie-bar (2) around a second axle (11) parallel to the support roll causes a forced pivoting of the tie-bar (2) with the rider roll (1) about the first axle (10), when the tie-bar (2) with the rider roll (1) is lifted in accordance with the increasing diameter of the roll, so that the acting direction of the rider roll (1) changes on the roll (12).

2. Rider roll unit according to claim 1, characterized in that the geometry of the guide-bar is variable.

3. Rider roll unit according to claim 2, characterized in that the articulation point (6) of the guide-bar (4) on the machine side is variable in position.

4. Rider roll unit according to claim 2, characterized in that the length of the guide-bar (4) is variable.

5. Rider roll unit according to claim 1, characterized in that the rider roll (1) can pivot into a position located to the side of the apex of the completed wound roll (12) so that by pivoting about the first axle (10), it can be used as an ejector for the roll (12) from the winding bed between the support drums (14 and 15).

* * * * *